United States Patent [19]

Dabich

[11] Patent Number: 4,535,908

[45] Date of Patent: Aug. 20, 1985

[54] DOUBLE HINGE COUNTER-WEIGHT COVER ASSEMBLY

[76] Inventor: Robert M. Dabich, 7212 Patterson Dr., Garden Grove, Calif. 92640

[21] Appl. No.: 644,875

[22] Filed: Aug. 27, 1984

Related U.S. Application Data

[63] Continuation-in-part of Ser. No. 538,187, Oct. 3, 1983, Pat. No. 4,467,932.

[51] Int. Cl.[3] ..... B65D 25/24

[52] U.S. Cl. ..... 220/18; 220/254; 220/255; 220/337

[58] Field of Search ..... 220/18, 254, 255, 334, 220/337

[56] References Cited

U.S. PATENT DOCUMENTS 3,190,039 6/1965 Carlson ..... 220/18
3,541,727 11/1970 Carlson ..... 220/18
4,065,020 12/1977 Carlson ..... 220/18
4,467,932 8/1984 Dabich ..... 220/18

*Primary Examiner*—George T. Hall
*Attorney, Agent, or Firm*—Charles H. Thomas

[57] ABSTRACT

A double lid assembly is provided for a pre-fabricated pit designed for installation below the surface of an aircraft docking and refueling area. A first, heavier lid is mounted by hinges on the pre-fabricated pit for rotation about a horizontal axis. A second, lighter lid is seated within the confines of the first lid and is rotatable about a second axis parallel to the first. When the second, lighter lid is opened, it reduces the force necessary to open the first, heavier lid by reducing the torsional moment holding the heavier lid shut. As the heavier lid is opened, the lighter lid serves as a counter-balance to facilitate opening the heavier lid.

15 Claims, 7 Drawing Figures

DOUBLE HINGE COUNTER-WEIGHT COVER ASSEMBLY

The present application is a continuation-in-part of U.S. application Ser. No. 538,187, filed on Oct. 3, 1983; now U.S. Pat. No. 4,467,932.

BACKGROUND OF THE INVENTION

1. Field of the Invention

The present invention relates to heavy lids for sub-surface enclosures, and particularly to lids on pre-fabricated pits designed for use in servicing aircraft, etc. at docking, loading and refueling terminals.

2. Description of the Prior Art

Servicing of aircraft on the ground at modern aircraft terminals is frequently performed using pre-fabricated pits which are installed at aircraft docking, fueling and loading areas. The pre-fabricated pits are installed beneath the surface of the tarmac across which aircraft travel during docking, refueling and departure maneuvers. The pits are typically formed of fiberglass, steel or aluminum, and are constructed as enclosures with surrounding walls, a floor, and an access lid at the top of the walls. The pits are installed below the surfaces of loading and refueling aprons at aircraft terminals, remote parking locations and maintenance bases.

Pre-fabricated pits of this type are used to allow ground support functions to be carried out from sub-surface enclosures. These ground support functions include the provision of fuel, the provision of electricity to aircraft located in the docking area, the provision of air for cooling the aircraft interior and pressurizing air for starting engines of the aircraft, and for other aircraft support activities which are conducted on the ground. The use of sub-surface pits eliminates the need for mobile trucks, carts and other vehicles which are otherwise present in the loading area and which interfere with the arrival and departure of aircraft in the vicinity of the loading gate. The use of sub-surface pits allows the provision of fuel, power, cooling and pressurized air, and other supplies from a central location. The necessary fluid supplies and electrical power can be generated or stored with great efficiency at a central location, as contrasted with the conduct of such ground support functions from mobile generating or supply vehicles.

The sub-surface, pre-fabricated pits used for ground support functions typically house valves, junction boxes, cooling air terminations and other terminal equipment used to service aircraft that have been docked. Umbilical pipes and lines, otherwise stored within the pits, are withdrawn from the pits through hatches therein and are coupled to the docked aircraft to supply the aircraft with fuel, air for cooling the aircraft interiors, pressurized air for starting the engines and electrical power.

Pre-fabricated pits for this purpose are typically constructed with hinged, disk-like hatches within a larger lid. The hatches are ordinarily used to withdraw fueling lines and the like, and can be lifted using one hand. Both the hatches and lids must be constructed of heavy duty aluminum or steel, or some other strong material, as they must be able to withstand the weight of an aircraft as it rolls across the hatches.

As opposed to the smaller hatches, conventional lids which cover the entire top of the pit cannot be lifted manually even though it is quite desirable to have access to the complete enclosure of the pit for servicing faulty equipment, freeing fouled lines, and for performing other maintenance and repair functions in the pit. Heretofore, it has been necessary to employ a motorized lift or other machine to raise the lid of a sub-surface pit because the pit lids are too heavy to be lifted manually. Pits of the type described are constructed in various sizes, and lids having dimensions of four to eight feet by three to five feet are typical. Accordingly, very large forces are required to lift up the lid.

SUMMARY OF THE INVENTION

The present invention provides a sub-surface pit with means assisted by gravity for opening the pit lids. According to the invention, a first, heavy outer lid is hinged to a lid support on a pre-fabricated pit. The heavy lid is mounted by a first hinge mechanism for rotational movement about a first horizontal axis of rotation. According to the invention, a second, smaller lid is mounted by a second hinge mechanism upon the first lid. The second lid moves in rotation about a second horizontal axis of rotation parallel to the first axis. The second lid is rotatably moved from a closed position, flush with the first lid, and through an obtuse angle to an open position. In the closed position the full weight of the lighter lid acts at the center of gravity of that lid to produce a moment about the first axis which combines additively with the weight of the first lid to hold the entire lid assembly closed on the top of the pit. However, when the second lid is opened, the center of gravity of the second lid is moved much closer to the first axis about which the first, heavier lid is rotatably mounted. Preferably, the center of gravity of the second lid passes across the axis of rotation of the first access lid as the second lid moves between its closed and open positions. The movement of the center of gravity of the second lid close to the first axis of rotation reduces considerably the torsional moment holding the first lid shut. It is therefore considerably easier to lift the first, heavy lid from the side thereof opposite the first hinge so as to open the lid assembly completely.

Preferably, the second lid not only reduces the force necessary to open the first lid, when the second lid is initially opened, but the center of gravity of the second lid actually passes over the axis of rotation of the first lid as the second lid is opened. The weight of the second lid thereby produces a moment which opposes the moment resulting from the weight of the first lid. This greatly reduces the force necessary to open the outer, heavier lid.

As the heavier lid is swung upwardly to approach an orientation perpendicular to its initial, closed, horizontal position, the second lid establishes contact with the surface beneath which the pre-fabricated pit is embedded. At this point, the weight of the first lid produces only a very small moment tending to close the lid, and the counter-balancing moment of the second lid is no longer required, and indeed is undesirable. It is at this time that the second lid establishes contact with the surface beneath which the pit is installed, and the torsional moment resulting from the weight of the second lid is reduced considerably.

According to the invention, the smaller lid which forms the access hatchway for fuel lines, and the like, is repositioned as it is opened so that the torsional moments of the two lids of the assembly do not act additively to prevent the outer, heavier lid from being opened, but instead act in concert to minimize the manual force which is required to completely uncover the top of the pre-fabricated pit. The smaller, central access hatch acts as a counter-balance during the time that the greatest force is necessary to raise the outer lid. However, due to the disposition of the second lid relative to the surface beneath which the pre-fabricated pit is mounted, this counter-balancing force is drastically reduced when the outer lid approaches perpendicular alignment relative to its initial, closed position.

Preferably, both of the lids are provided with some form of cushioning mechanisms which are compressed as each lid nears the fully opened position. The cushioning devices may take the form of compressible, hard rubber sleeves or washers which are interposed between each lid and the structure to which the lid is rotatably mounted. That is, cushions may be interposed between the lighter, inner lid and the heavier, outer lid in which the inner lid is seated. The cushions are not compressed when the inner lid is closed, but are compressed as the inner lid approaches a fully open position. Likewise, cushions may be interposed between the heavier, outer lid and the supporting structure of the pre-fabricated pit. Again, the cushions are not compressed when the outer lid is closed, but are compressed as the outer lid approaches its fully opened position.

According to the invention, the lid assembly of a sub-surface pit is divided into two portions, each independently rotatable about mutually parallel, horizontal axis. In this manner, the weight of the lid assembly is apportioned between two separate structures which can be individually manipulated so as to selectively vary the magnitude and direction of the torsional moment of the entire lid assembly about the hinge mechanism by which it is rotatably mounted to the supporting structure of the pre-fabricated pit. The force necessary to lift the lid assembly can thereby be controlled so that the lid assembly can be lifted manually without the aid of power driven machinery.

The invention may be described with greater clarity and particularity by reference to the accompanying drawings.

DESCRIPTION OF THE EMBODIMENT

Figure 1:
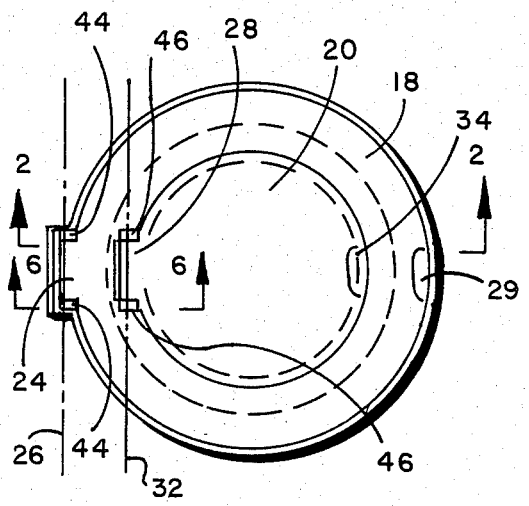
FIG. 1 is a top plan view of a lid assembly according to the invention with both lids closed.

The drawings illustrate the upper portion of a generally cylindrical shaped sub-surface, pre-fabricated pit 10, typically constructed of fiberglass. At its upper extremity the pit 10 terminates in a lip 12 which forms a horizontal ledge projecting radially outwardly from the cylindrical portion of the pit 10. The ledge formed by the lip 12 exists in several levels about the periphery of the pit 10, and is deepest beneath the hinge area of a lid assembly 14. The lip 12 provides a lid support and the lid assembly 14 closes the upper end of the pre-fabricated pit 10 to define a sub-surface chamber 16 therewithin.

The lid assembly 14 is formed of dual access lids 18 and 20 having different weights and formed in different configurations. The first, outer lid 18 is the heavier of the two lids and is mounted on the pit 10 by means of a first hinge axle 22 which passes through a radially outwardly extending flange 24 on the first lid 18. The hinge axle 22, visible in FIGS. 6 and 7, defines a first axis of rotation indicated at 26 in FIGS. 1 through 5. The inner edge of the annular lid 18 forms a supporting ledge 27 for the second or inner lid 20. The first lid 18 is rotatable about the first horizontal axis 26. The first lid 18 has a grip formed on its outer perimeter by a recess 29 located opposite the flange 24. The lid 18 may be lifted by means of this grip as will hereinafter be described.

The second, inner lid 20 is also formed of cast aluminum and is shaped generally as a disk with a radially outwardly extending flange 28. The periphery of the lid 22 rests upon the supporting ledge 27 defined by the first lid 18. A second hinge axle 30 extends through the flange 28 and defines a second, horizontal axis of rotation 32 which is parallel to the first axis 26. A radially inwardly extending recess 34 is defined in the periphery of the lid 20 opposite the flange 28. The recess 34 defines a finger grip so that the lid 20 can be manually lifted and rotated from the closed position of FIG. 2 to the open position of FIG. 3 about the axis 32. A force of about 25 pounds, or 11 kilograms, is required to lift the lid 20. The lid 20 can be opened with one hand by most users.

Figure 2:
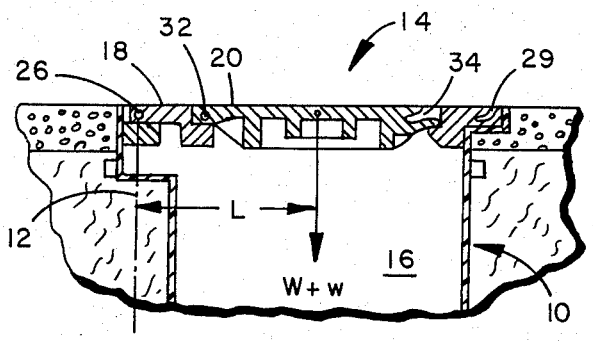
FIG. 2 is a sectional elevational view of FIG. 1 taken along the lines 2—2 thereof.

When the first and second lids 18 and 20, respectively, are both closed, they create a very large moment holding the assembly 14 shut. As illustrated in FIG. 2, the combined weight of the lids 18 and 20 acts vertically downwardly through the axial center of the pre-fabricated pit 10. The moment created is equal to the combined weight of the two lids 18 and 20, $W+w$, respectively, acting at a moment arm L. With the lids 18 and 20 both closed as depicted in FIG. 2, the lid assembly 14 cannot be manually opened to provide access for servicing faulty equipment, freeing fouled lines, and for performing other maintenance and repair functions in the pit 10. When the second lid 20 is shut, as depicted in FIG. 2, the weight of the lid 20 increases the moment of force urging the first lid 18 shut. When the lids 18 and 20 are both closed, the second axis 32 is located between the first axis 26 and the center of gravity of the lighter lid 20.

Figure 3:
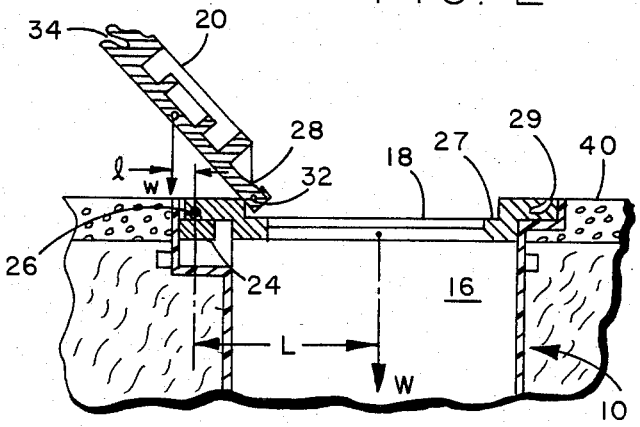
FIG. 3 is a sectional elevational view showing the inner, lighter lid of the lid assembly fully opened.

The lid 20 is normally rotated open from the position of FIG. 2 to the position of FIG. 3 for the purpose of withdrawing fuel lines, air ducts and other supply lines. When the lid 20 is opened to the position of FIG. 3, the weight w of the second lid 20 decreases the moment of force urging the first lid 18 shut. The lid 20 is rotated from the closed position of FIG. 2 through an obtuse angle of about 135° to the fully open position of FIG. 3. As the lid 20 is opened, its center of gravity passes across the axis of rotation 26 of the first lid 18. As depicted in FIG. 3, when the second lid 20 is opened, the moment urging the lid 18 shut is equal to the difference between the moments of the weights of the lids 18 and 20 acting through their respective centers of gravity. The moment produced by the lid 20 when it is open is in a counterclockwise direction about the axis 26 and is equal to the weight w of the lid 20 acting through the very small lever arm 1. The moment of the weight W of the heavier lid 18 continues to act in a clockwise direction about the axis 26 at the lever arm L. Due to the counter-balancing effect of the counterclockwise moment attributable to the second lid 20, it is thereupon possible to manually lift the lid 18 with a force of only about 25 pounds, or 11 kilograms, rotating it upwardly about the axis of rotation 26.

Unless some lifting force is applied, the heavier lid 18 will still remain closed atop the opening of the pre-fabricated pit 10 even when the lid 20 is fully opened as depicted in FIG. 3. The lids 18 and 20 must be constructed and mounted so that the mere act of opening the lid 20 does not cause the lid 18 to pop open as well. However, once a relatively small manual force is applied to begin lifting the heavier lid 18 in an arc about the axis 26, the center of gravity of the lighter lid 20 passes even further to the left and the weight of the lid 20 acts at an increasing moment arm. That is, the weight w of the lid 20 produces an increasing counterclockwise moment which acts in opposition to the decreasing clockwise moment attributable to the weight W of the heavier lid 18, as viewed in FIGS. 3 and 4. By reducing the moment which must be overcome in order to lift the heavier lid 18, it is possible to manually open the entire lid assembly 14.

Figure 5:
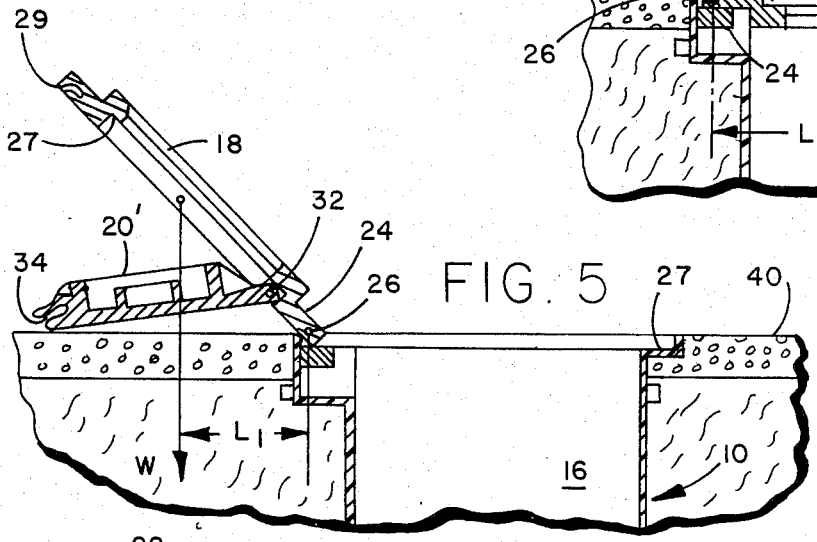
FIG. 5 is a sectional elevational view showing the lids of the lid assembly when the heavier lid is fully opened.
Figure 4:
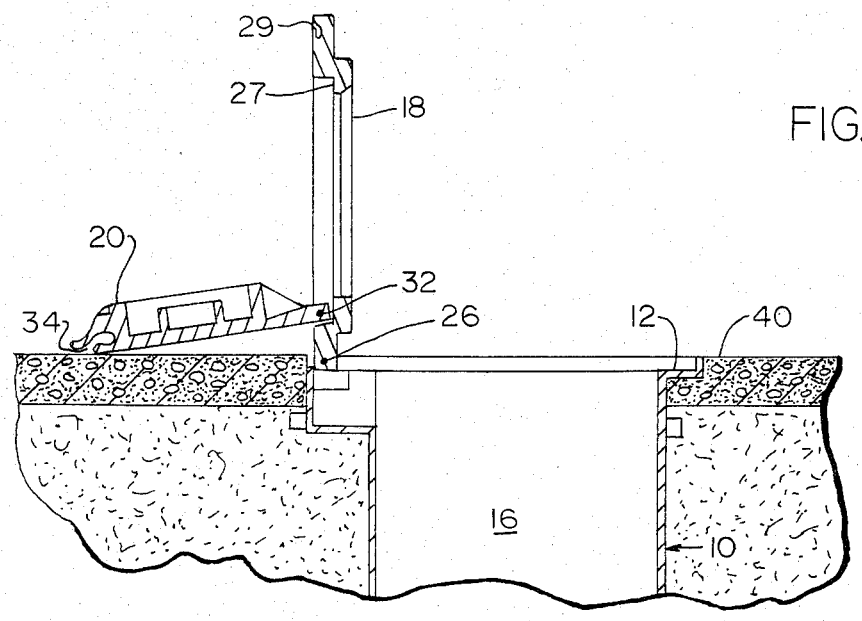
FIG. 4 is a sectional elevational view showing the lighter lid open and the heavier lid partially opened.

The moment attributable to the lighter lid 20 continues to increase and oppose the diminishing moment attributable to the heavier lid 18, as the heavier lid 18 is opened further. As the heavier lid 18 approaches an orientation perpendicular to its closed position of FIG. 2, as illustrated in FIG. 4, the clockwise moment of the heavier lid 18 becomes quite small. With counterclockwise movement of the heavier lid 18 the opposing moment of the lighter lid 20 increases. Once the moment attributable to the weight W of the heavier lid 18 reverses its direction from clockwise to counterclockwise, the additional counterclockwise moment attributable to the weight w of the lighter lid 20 is undesirable. However, the system of the invention avoids such a condition because as soon as the heavier lid 18 is rotated counterclockwise to approach a position nearly perpendicular to its closed position of FIG. 2, the edge of the lighter lid 20 adjacent the recess 34 makes contact with the surface 40 beneath which the pit 10 is mounted, as illustrated in FIG. 4. As soon as this contact is established, the counterclockwise moment attributable to the lighter lid 20 is sharply reduced. This prevents an inordinately large counterclockwise moment from developing as the center of gravity of the larger lid 18 passes over the axis of rotation 26. Counterclockwise rotation of the heavier lid 18 proceeds, but is aided only by the counterclockwise moment attributable to the weight W of the larger lid 18 acting at the distance $L_1$ from the axis 26, as illustrated in FIG. 5. With the edge of the lighter lid 20 in contact with the surface 40, the majority of the weight w of the lighter lid 20 is carried by the surface 40, and only a very small counterclockwise moment attributable to the lighter lid 20 is added to that of the heavier lid 18. The heavier lid 18 can be rotated through an arc of about 135° to its fully opened position illustrated in FIG. 5. As the lid 18 is rotated from the position of FIG. 4 to the position of FIG. 5, the edge of the lid 20 is pushed across the surface 40.

Preferably, resilient abutments are provided to serve as cushions and to limit to an obtuse arc the movement of the second lid 20 relative to the first lid 18, and to limit the movement of the first lid 18 relative to the structure of the pit 10. Such resilient abutments may be formed of hard rubber sleeves 42 carried upon hinge pins 44 and 46 depending from the ends of the axles 22 and 30, respectively, as illustrated in FIGS. 6 and 7.

The hinge pins 44 are formed with eyes at their upper extremities which receive the ends of the axle 22 on either side of the flange 24 of the first lid 18. The shanks of the hinge pins 44 extend downwardly through a radially inwardly directed frame hinge base mount 48. The frame hinge base mount 48 is rigidly secured to the lip 12 of the pit 10. A frame hinge pin bushing 48 supports the rubber sleeve 42, and in turn is held in position on the shank of the hinge pin 44 by a retaining ring 50.

Figure 6:
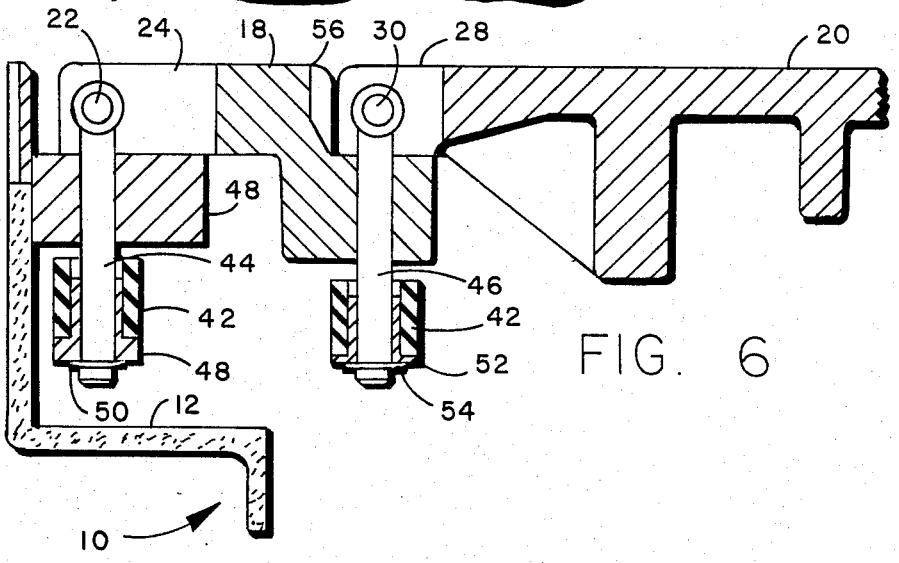
FIG. 6 is a sectional detail taken along the lines 5—5 of FIG. 1.
Figure 7:
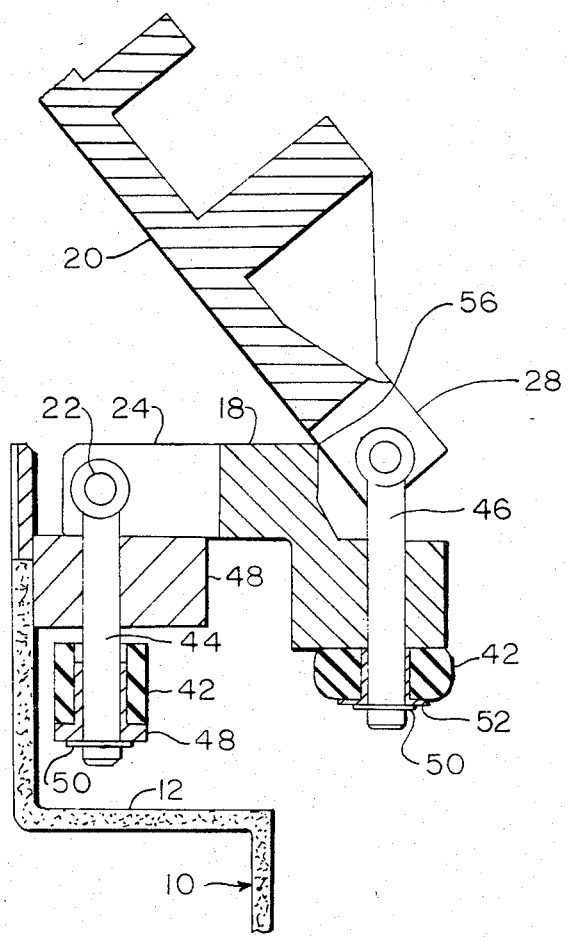
FIG. 7 is a sectional detail corresponding to that of FIG. 6 with the lighter, inner lid in the fully opened position.

When the first lid 18 is closed in the position indicated in FIGS. 2 and 6, the rubber sleeve is not compressed, and the lid 18 may be freely opened. However, as the lid 18 is raised, the rubber sleeve 42 is increasingly compressed and performs a resilient cushioning function. The rubber sleeve 42 prevents damaging shocks to the flange 24, the axle 22 and the frame hinge base mount 48, should the first lid 18 be abruptly thrown to its fully open position depicted in FIG. 5.

Similarly, a cover hinge pin bushing 52 supports the compressible rubber sleeve 42 on the shank of the hinge pin 46 depending from the ends of the axle 30 on either side of the flange 28 of the second, lighter lid 20. The shanks of the hinge pins 46 pass through apertures in the structure of the shelf 27 formed by the larger lid 18. The compressible rubber sleeves 42 likewise serve as cushioning shock absorbers to prevent damage to the flange 28, the hinge 30, and the structure of the lid 18, should the lid 20 be forced violently to its fully open position, depicted in FIG. 3.

The resilient rubber sleeves 42 also serve as abutments to limit the rotational movement of both of the lids 18 and 20. To illustrate, the sleeves 42 on the hinge pins 46 are not compressed when the inner lid 20 is in the closed position, as depicted in FIG. 6. However, when the lid 20 is opened by upward rotation, the structure of the top of the flange 28 is brought into contact with the structure of the first lid 18. The corner 56 of the lid 18 serves as a fulcrum which pulls the flange 28 and axle 30 upwardly, thereby compressing the rubber sleeve 42, as illustrated in FIG. 7. When the second lid 20 has been rotated from the position of FIG. 6 through an arc of about 135° to the position of FIG. 7, the rubber sleeve 42 is resiliently compressed and the bushing 52 reaches abutment against the underside of the lid 18. The second lid 20 therefore cannot be opened any further and will not rotate a complete 180° to reach contact with the surface 40. To the contrary, the second lid 20 is maintained in the elevated position of FIG. 7 so that the weight of the lid 20 serves as a dynamic force creating a counterclockwise moment which assists in raising the first lid 18 if the necessary force is applied to the hand grip formed by the recess 29 in the lid 18. Similarly, the bushing 48 limits the rotational movement of the first lid 18 to an arc of about 135°. As a consequence, the force necessary to close the lid 18 is limited, since the counterclockwise moment which must be overcome can be no greater than the weight W of the lid 18 acting through the lever arm $L_1$, as depicted in FIG. 5. As the heavier lid 18 is closed and the center of gravity of the lid 18 passes over the axis 26, the limiting abutment formed by the bushing 52 causes the edge of the lid 20 to be lifted from the surface 40. The lid 20 thereby provides a counter-balancing moment to aid in controlling the clockwise rotation of the outer lid 18 as the outer lid 18 is closed from the position of FIG. 4 to the position of FIG. 3.

Undoubtedly, numerous other variations and modifications of the invention will become readily apparent to those familiar with pre-fabricated pit construction. Accordingly, the scope of the invention should not be construed as limited to the specific embodiment depicted and described, but rather is defined in the claims appended hereto.

I claim:

1. A lid assembly for a subsurface chamber comprising a support for covering the top of a subsurface chamber, a first access lid, first hinge means mounting said first access lid on said support for rotational movement about an axis of rotation between closed and open positions, a second, smaller access lid, second hinge means mounting said second lid on said first lid for rotational movement through an obtuse angle when said first lid is in a closed position such that the center of gravity of said second lid passes across the axis of rotation of said first access lid as said lid moves between closed and open positions.

2. A lid assembly according to claim 1 wherein an abutment means limits the angle through which said second lid can rotate relative to said first lid.

3. A lid assembly according to claim 2 wherein said abutment means is comprised of resilient cushioning means acting between said second lid and said first lid when said second lid is fully opened.

4. A lid assembly according to claim 1 further comprising resilient cushioning means acting between said first lid and said support to limit the extent to which said first lid opens.

5. A lid assembly according to claim 1 in which said first lid encircles and forms a seat for said second lid.

6. A lid assembly according to claim 5 in which said support encircles and forms a seat for said first lid.

7. In a subsurface pit having a lid support, a first lid, first hinge means mounting said first lid to said lid support for rotational movement about a first horizontal axis of rotation, the improvement comprising a second, smaller lid, second hinge means mounting said second lid to said first lid for rotational movement about a second horizontal axis of rotation parallel to said first axis of rotation so that the weight of said second lid increases the moment of force urging said first lid shut when said second lid is shut and the weight of said second lid decreases the moment of force urging said first lid shut when said second lid is open.

8. A subsurface pit according to claim 7 further comprising resilient abutment means which cushions and limits to an obtuse arc the movement of said second lid relative to said first lid.

9. A subsurface pit according to claim 7 in which said lid support forms a seat for said first lid and said first lid forms a seat for and surrounds said second lid.

10. A double lid assembly for a prefabricated pit for servicing aircraft comprising dual access lids of different weights, the heavier of said lids being mounted on said pit for rotational movement in an arc about a first horizontal axis, and the lighter of said lids being mounted on said heavier lid for rotational movement between open an closed positions about a second axis parallel to said first axis, and said first axis is located between said second axis and the center of gravity of said lighter lid when said lighter lid is opened.

11. A double lid assembly for a prefabricated pit according to claim 10 further characterized in that the center of gravity of said lighter lid passes over both said first and second axis when said lighter lid is fully opened from a closed position.

12. A double lid assembly according to claim 11 further characterized in that said lighter lid is at an angle of about 135° relative to said heavier lid when fully opened relative thereto.

13. A double lid assembly according to claim 12 further comprising means for limiting the rotation of said heavier lid to an arc of about 135°.

14. A double lid assembly according to claim 10 further characterized in that said lighter lid is limited in arcuate movement relative to said heavier lid, and when opened, exerts a torsional moment opposing the moment resulting from the weight of said heavier lid in its closed position.

15. A double lid assembly according to claim 14 further characterized in that the torsional moment resulting from the weight of said lighter lid in its open position is sharply reduced when said heavier lid is rotated through a predetermined arc.

* * * * *